US006497180B1

(12) United States Patent
Martin

(10) Patent No.: US 6,497,180 B1
(45) Date of Patent: Dec. 24, 2002

(54) ELECTRIC ACTUATED EXPLOSION DETONATOR

(76) Inventor: Philip N. Martin, 4319 S. Canton Ave., Tulsa, OK (US) 74135

( * ) Notice: Subject to any disclaimer, the term of this patent is extended or adjusted under 35 U.S.C. 154(b) by 0 days.

(21) Appl. No.: 09/767,788

(22) Filed: Jan. 23, 2001

(51) Int. Cl.[7] ..... F42B 3/10
(52) U.S. Cl. ..... 102/202.7; 102/322
(58) Field of Search ..... 102/202.7, 322

(56) References Cited

U.S. PATENT DOCUMENTS

| | | | | |
|---|---|---|---|---|
| 3,636,390 A | | 1/1972 | Stauder et al. | 310/14 |
| 4,050,382 A | | 9/1977 | Power | 102/16 |
| 4,103,619 A | | 8/1978 | Fletcher et al. | 102/28 R |
| 4,130,060 A | | 12/1978 | Murray | 102/39 |
| 4,145,970 A | | 3/1979 | Hedberg et al. | 102/218 |
| 4,223,759 A | | 9/1980 | Martin | 181/116 |
| 4,311,096 A | | 1/1982 | Oswald | 102/202.13 |
| 4,324,310 A | | 4/1982 | Wener et al. | 181/116 |
| 4,454,814 A | | 6/1984 | Henry et al. | 102/200 |
| 4,699,241 A | | 10/1987 | Kerekes | 181/116 |
| 4,712,477 A | | 12/1987 | Aikou et al. | 102/206 |
| 4,867,266 A | | 9/1989 | Martin | 181/106 |
| 4,869,170 A | | 9/1989 | Dahmberg et al. | 102/202.5 |
| 4,951,570 A | | 8/1990 | La Mura et al. | 102/202.11 |
| 4,991,684 A | | 2/1991 | Mitchell | 181/106 |
| 5,488,908 A | * | 2/1996 | Gilpin et al. | 102/202.7 |
| 5,503,077 A | * | 4/1996 | Motley | 102/202.7 X |
| 5,509,354 A | | 4/1996 | Dorffler et al. | 102/202 |
| 5,732,634 A | | 3/1998 | Flickinger et al. | 102/202.5 |
| 6,085,659 A | * | 7/2000 | Beukes et al. | 102/202.7 X |
| 6,230,625 B1 | * | 5/2001 | Neyer et al. | 102/202.7 X |
| 6,237,494 B1 | * | 5/2001 | Brunet et al. | 102/202.7 |

* cited by examiner

*Primary Examiner*—Peter A. Nelson
(74) *Attorney, Agent, or Firm*—Gable & Gotwals; Paul H. Johnson

(57) ABSTRACT

An electric actuated explosion detonator for use to detonate a confined explosive charge capable of being detonated by heat and/or shock, including an electrical resistor positioned in engagement with the confined explosive charge, the resistor having two electrical contacts and having a predetermined maximum electric current carrying capability and subject to receiving, by the application of an electrical energy source, sufficient voltage and wattage that an instantaneous current flow causes the resistor to instantaneously disintegrate.

16 Claims, 3 Drawing Sheets

ELECTRIC ACTUATED EXPLOSION DETONATOR

REFERENCE TO PENDING APPLICATION

This application is not related to any pending United States or international patent application.

REFERENCE TO MICROFICHE APPENDIX

This application is not referenced in any Microfiche Appendix.

BACKGROUND OF THE INVENTION

Explosion detonators are used whenever it is required to initiate or set off an explosive charge. Explosives may be in the form of solids, liquids or powders and are typically set-off either by heat or shock or a combination of heat and shock. A common initiated explosion is that which takes place in a shell, whether a rifle or shotgun shell, in which a detonation actuates an explosive that propels a projectile or projectiles, such as a lead slug or lead shot, out the muzzle of a gun. Other types of detonators are used to set off explosives used in mining and construction, such as dynamite, nitroglycerin and many other types of more modern explosive compositions. Military equipment including cannons, howitzers and so forth frequently function by loading bags of explosive into the breach of a gun barrel that has a projectile therein and detonating the explosive after the breach is closed to expel the projectile at high velocity.

For background information relating to explosion detonators, reference may be had to the following previously issued United States patents:

| U.S. PAT. NO. | INVENTOR | TITLE |
|---|---|---|
| 3,636,390 | Stauder et al. | Explosive Pulse Generator |
| 4,050,382 | Power | Electrically Detonated Explosive Device |
| 4,103,619 | Fletcher et al. | Electroexplosive Device |
| 4,130,060 | Murray | Pyrotechnic Devices |
| 4,145,970 | Hedberg et al. | Electric Detonator Cap |
| 4,223,759 | Martin | Low Energy Source for Seismic Operation |
| 4,311,096 | Oswald | Electronic Blasting Cap |
| 4,324,310 | Wener et al. | Seismic Apparatus |
| 4,454,814 | Henry et al. | Select-Fire Systems and Methods for Perforating Guns |
| 4,699,241 | Kerekes | Method and Apparatus for Detonation of Distributed Charges |
| 4,712,477 | Aikou et al. | Electronic Delay Detonator |
| 4,869,170 | Dahmberg et al. | Detonator |
| 4,867,266 | Martin | Seismic Energy Source |
| 4,951,570 | La Mura et al. | Electrically Activated Detonator with Pyrotechnic Device Receiving Terminals and Method of Making |
| 4,991,684 | Mitchell | Method and Apparatus for Detonation of Distributed Charges |
| 5,509,354 | Dorffler et al. | Igniter Holder |
| 5,732,634 | Flickinger et al. | Thin Film Bridge Initiators and Method of Manufacture |

The invention herein relates specifically to an explosion detonator that is particularly useful in firing relatively small explosive charges such as the type of charge frequently found in shotgun shells that may typically vary in size from 410 gauge to 8 gauge industrial. The invention herein is also particularly applicable for firing shells that are not intended to be utilized as ammunition in a weapon but are intended for industrial purposes, such as 8 gauge industrial shells.

Shotgun size shells are frequently utilized in geophysical mapping.

For background information relating to the use of small explosives of the shotgun shell size in geophysical mapping reference may be had to U.S. Pat. No. 4,867,266 entitled, "Seismic Energy Source" that issued on Sep. 19, 1989. Another example of the use of shotgun size shells in a seismic system may be found in U.S. Pat. No. 4,324,310 entitled, "Seismic Apparatus" that issued Apr. 13, 1982. An even earlier example of the use of small size explosives, such as shotgun shells, for scientific exploration is revealed in U.S. Pat. No. 4,223,759 entitled, "Low Energy Source for Seismic Operation" that issued on Sep. 23, 1980.

When seismic exploration is conducted using small explosive charges such as the size approximated by shotgun shells, it is important that an electric actuated explosive detonator be available that is highly dependable, inexpensive, safe to handle and electrically initiated. Many types of small explosives such as shotgun shells and particularly the shotgun shells utilized for hunting and other recreational activities employ a primer cap that is initiated by physical detonation—that is, a pin strikes and deforms a percussion primer cap to initiate the explosion of the charge that propels projectiles from the barrel of a gun. In seismic exploration it is much preferred that the ignition of explosive charges be accomplished electrically rather than physically since the physical action of a mechanism may introduce erratic firing times that complicate the energy pattern generated by the explosive charge, especially multiple charges that must be fired simultaneously. It is, therefore an object of this invention to provide an electric actuated explosive detonator that meets all of the requirements above mentioned for detonators, particularly for detonators used for seismic exploration, by providing a detonator that is inexpensive, highly dependable, and easily adaptable for use in portable equipment.

BRIEF SUMMARY OF THE INVENTION

The present invention provides an electric actuated explosion detonator that includes a confined explosive charge capable of being detonated by heat and/or shock. A carbon film electric resistor is positioned in engagement with the confined electric charge. The carbon film resistor has two electrical contacts and has a predetermined electric current carrying capability and is subject to receiving, by the application of an electrical source of sufficient voltage and wattage an instantaneous current flow to cause the carbon film resistor's immediate disintegration.

A carbon film electric resistor adaptable for use in this invention may, and preferably is, of the readily commercially available type of carbon film resistors as characteristically employed in electric and electronic circuitry. Such carbon film resistors are typically formed in the shape of a small diameter cylindrical device with electrodes on the opposed ends of the device. Most frequently the electrodes are in the form of two wires, one extending from each of the opposed ends of a cylindrical shaped carbon film resistor.

A typical electrical resistor that functions ideally in the practice of this invention may be of a size of about ¼ watt and may be typically about 15 to 25 ohms and of the carbon film type. Such carbon film resistors are commonly available on the market at a cost of less than two or three cents each.

In the practice of the invention, the confined explosive charge may typically be an explosive propellant of the type commonly used in manufacturing ammunition.

The explosive charge or propellant used in practice in the invention may be confined, as an example, within a shell cartridge. The shell cartridge may be of the type that has a metal head and a non-metallic casing. The metal head may typically be of the type that has a central opening through which the resistor may be positioned to be immersed within explosive powder packed within the shell casing.

In one embodiment of the invention, an electric actuated explosive detonator is in the form of a shell having a metal head portion having an opening therein and having a small tubular insulator received in the opening. One conductor wire from a carbon film resistor may extend through the tubular opening to be attached to a contact button that is received within the opening in the shell head portion.

While the resistor as used in this invention may be any kind of electrical resistor that has a maximum current carrying capability and that has conductors extending from it, the ideal commercially available resistor is the carbon film resistor.

A typical commercially available resistor that functions ideally in practicing the invention is a carbon-film resistor of about 20 ohms and ¼ watt. The ohmage and wattage can vary up or down from these amounts but the objective of the invention is achieved only when a resistor of ohmage and wattage is used, according to the power source available, such that upon the application of a power source, either A/C or D/C to the resistor, it immediately disintegrates due to excess current flow that immediately exceeds the resistor's wattage. A power supply that can be used to activate the explosive detonator of this invention can be of the type that produces 110/120 volts A/C that can be energized either from a readily available household current 110/120 volts A/C outlet or that can be obtained from an inverter that operates on 12 volts or similar battery. By the use of an inverter that uses a 12 volt or similar battery as an energy source to provide an elevated D/C or an elevated A/C output of approximately 110/120 volts, the explosion detonator can easily be used in field conditions and with equipment that is readily commercially available and exceedingly economical.

A better understanding of the invention will be obtained from the following detailed description of the preferred embodiments taken in conjunction with the attached drawings.

DESCRIPTION OF THE DRAWINGS

In FIG. 2, a prepared shell in the general form of a typical shotgun shell is positioned within a housing secured to a lower end of a rod. The rod is extended into a hole bored into the earth's surface. Conductor wires extend from the upper end that can be connected to an electrical energy source to ignite the explosive detonator to fire the shells positioned in the housing.

DETAILED DESCRIPTION OF A PREFERRED EMBODIMENT

Figure 1:
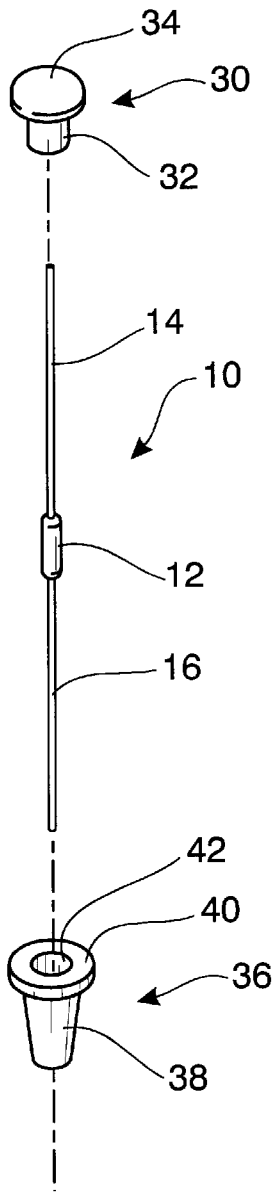
FIG. 1 is an exploded view showing a contact button, a carbon film electrical resister having lead wires extending from the opposed ends thereof and a hollow, plastic, tubular insulator with a lip top. These three components can be used to provide a detonator in conjunction with a typical shell, such as a shotgun shell.

Referring to FIG. 1, a typical commonly available and inexpensive carbon film resistor is indicated by the numeral 10. Carbon film resistor 10 is a type commonly employed in electrical and electronic circuits and includes a body 12 that has therein a current carrying resistive element surrounded by an insulating material. Extending from body 12 is a first conductor 14 and in the opposite direction a second conductor 16. The elements 12, 14 and 16 are integrally formed as supplied by manufacturers. A user can bend bare wires 14 and 16 as required and cut the length of the wires to fit with other electrical components in making up electrical circuits.

The invention herein makes use of this standard readily commercially available small size and inexpensive carbon film resistor 10 in a system to provide an electric activated explosive detonator. The invention is achieved by contacting carbon film resistor body 12 with an explosive charge that is capable of being detonated by heat and/or shock. The explosive charge may be a solid, a liquid or a powder. In the typical application of the invention, the explosive charge is preferably an explosive propellant that is readily commercially available and of the type commonly used in shotgun shells.

Figure 1A:
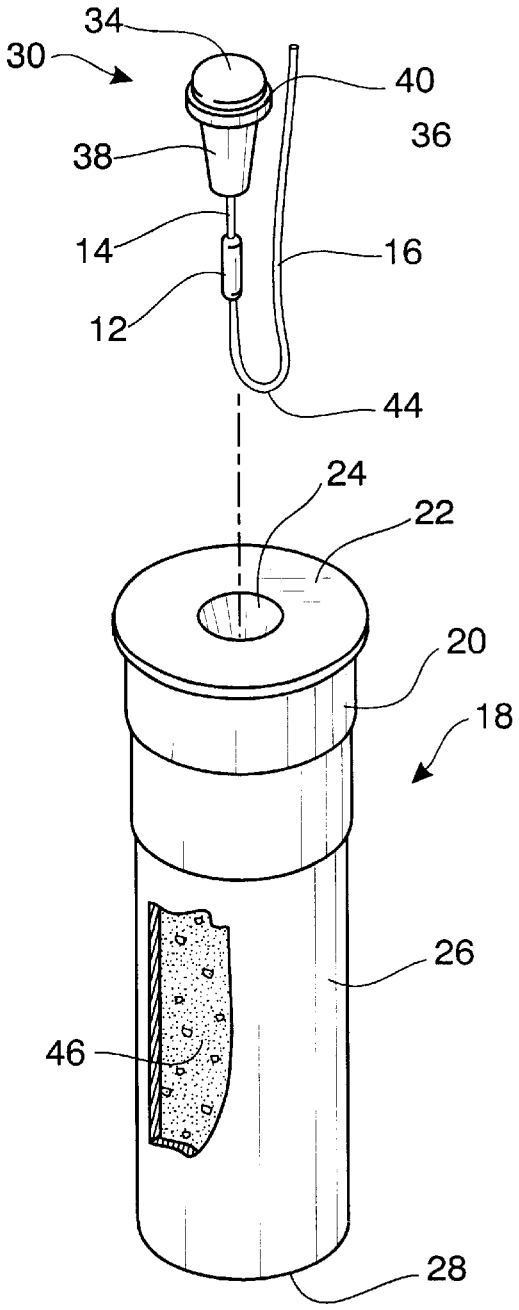
FIG. 1A shows a typical shotgun shell having a metal head and a non-metal casing with a hole in the metal head that can receive the assembly of components illustrated in FIG. 1.

A common means of containing an explosive charge or explosive propellant is exemplified by a common shotgun shell 18 as seen in FIG. 1A. Shotgun shell 18 includes typically a metal head 20, commonly made of easily formable metal such as brass, that has an end surface 22 having a central opening 24 therein. Opening 24 provides access from the exterior to the interior shell head 20.

Affixed to and extending from metal head 20 is a shell casing or shell hull 26 that usually is formed of non-metallic materials such as treated heavy duty paper or plastic.

The shotgun shell 18, as seen in FIG. 1, is as previously stated a commonly available type of explosive device. In commercial use such as for hunting purposes, the shell hull 26 has a powder in the upper portion including the metal head 20 and in between the powder and the outer end 28 of the casing wadding and adjacent the outer end shot with the end 28 being closed. If this explosive device alone is to be used for generating seismic energy it is not necessary to include wadding or shot within shell hull 26.

The typical shotgun shell that is fired in a shotgun has a primer cap that appears like button 30 as seen in FIGS. 1 and 1A. Such primer cap buttons are charged with a particular explosive that ignites upon indentation of the primer cap which is usually accomplished by a firing pin that is struck by a hammer. Primer cap 30 is made of metal, such as brass, and has a tubular portion 32 and an outer end top hat portion 34. Primer cap 30 as used in this invention and as illustrated in FIGS. 1 and 1A does not include an explosive and does not function by being indented or deformed by a firing pin; instead, primer cap 30 serves only as an electrode by which a voltage can be applied across carbon film resistor 10. For this purpose first conductor 14 is soldered or welded or otherwise secured in electrical contact with primer cap 30.

Figure 2:
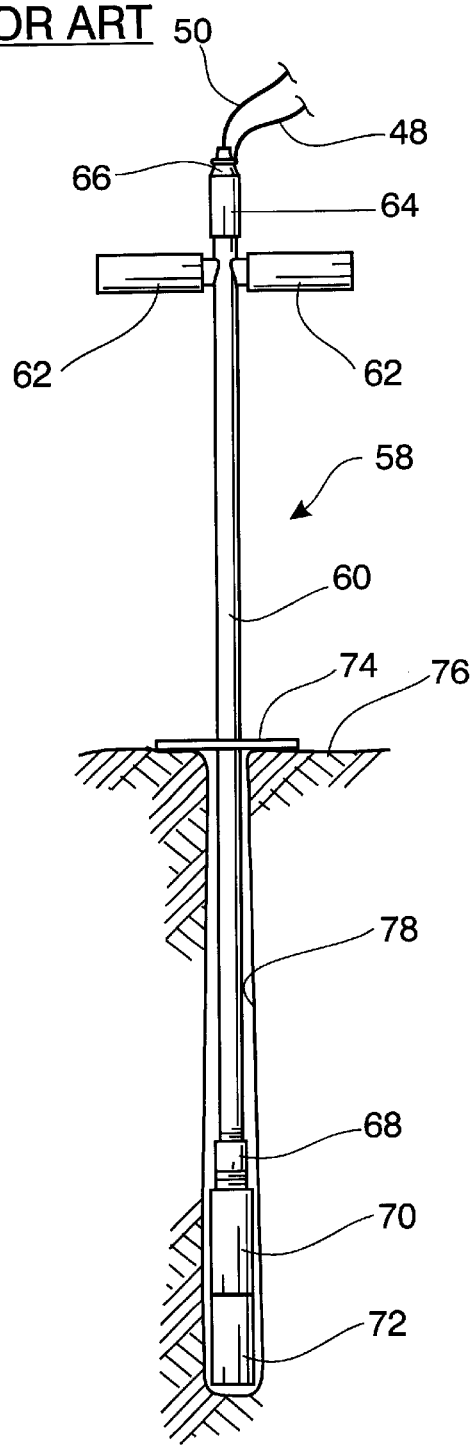
FIG. 2 PRIOR ART
FIG. 2 illustrates a method of making use of the invention for generating a seismic energy source.

As seen in FIGS. 1 and 2, the assembly further includes a hollow tubular insulator 36 that is typically made of plastic. The tubular insulator has a hollow conical portion 38 and a circumferential top flange portion 40. Insulator 36 is inserted into opening 24 in the metal head 20 of shell 18. More specifically, the tubular portion 32 of primer cap 30 is inserted into central opening 42 in tubular insulator 36. In assembling the device, the first conductor 14 is cut to the proper length, extended through insulator 36 and welded or soldered to primer cap 30. The resistor second conductor 16 is bent upwardly as shown in FIG. 1 to provide a lower bight portion 44 and it is extended with resistor 12 down through opening 24 in metal head 20. The second conductor 16 remains exterior of tubular insulator 36 and is held in contact with metal head 20. Thus, as assembled, electrical continuity exists between the top hat portion 34 of primer cap 30, through first conductor 14, resistor 10, second conductor 16 to metal head 20. Therefore, resistor 10 can be caused to suddenly disintegrate by applying an electrical charge between the top hat portion 34 of primer cap and metal head 20. Resistor 10 in the assembled shell is positioned within and surrounded by an explosive charge 46 packed within the shell casing 26 and metal head 20. The term "explosive charge" includes explosive propellants such as used in ammunition.

Figure 4:
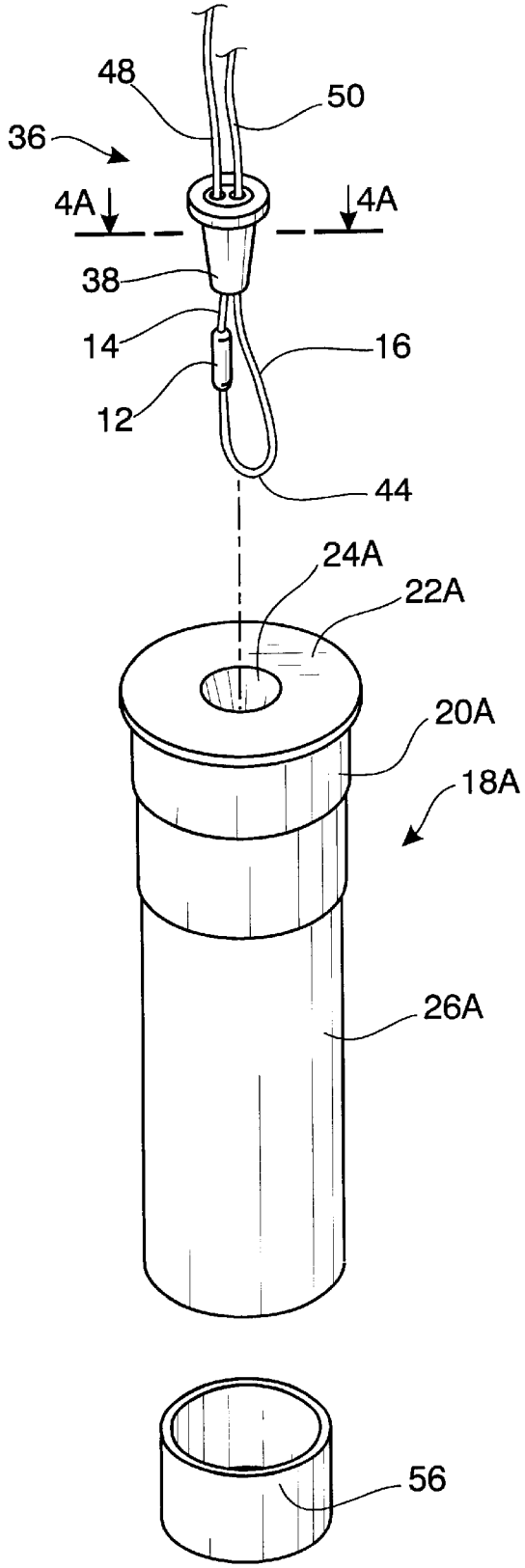
FIG. 4 shows the application of the invention in an exploded view. Leads extending from a carbon film resistor extend through a tubular insulator plug. The carbon film resistor passes through an opening in the metal head portion of a shell and into an explosive charge within the shell. Explosives of the type illustrated in FIG. 4 are employed in the systems illustrated in FIGS. 2 and 3.

FIG. 4 shows a slightly alternate embodiment of the invention and shows an exploded view as in FIG. 1A of a shell 18A that is illustrated as being of a smaller diameter, such as typically represented by a 410 gauge shotgun shell. The shotgun shell 18A has metal head 20A and a shell hull 26A, the head having an opening 24A all as described with reference to FIG. 1A. Positioned within the shell, which is filled with an explosive charge such as the explosive charge 46 as seen in FIG. 1A, is the assembly having resistor 10 with conductors 14 and 16 extending from it. The resistor is positioned through opening 24A so as to be in contact with or preferably immersed within a powder explosive charge. The arrangement of FIG. 4, however, is different from FIG. 1 in that no primer cap is employed and the shell metal head 20A is not used as a conductor for firing the shell. Instead, in the arrangement of FIG. 4, a first flexible insulated conductor 48 is attached to resistor first conductor 14 and a second flexible insulated conductor 50 is connected to resistor second conductor 16. The conductors 48 and 50 may be as long as necessary and can extend as required to attach to an electrical source by which current can be caused to surge through and immediately disintegrate resistor 10 to fire the explosive charge Within shell 18A. The resistor arrangement in FIG. 4 functions exactly as in FIG. 1A, however, the circuitry for connecting an electrical charge to cause current to flow through the resistor is different.

Figure 4A:
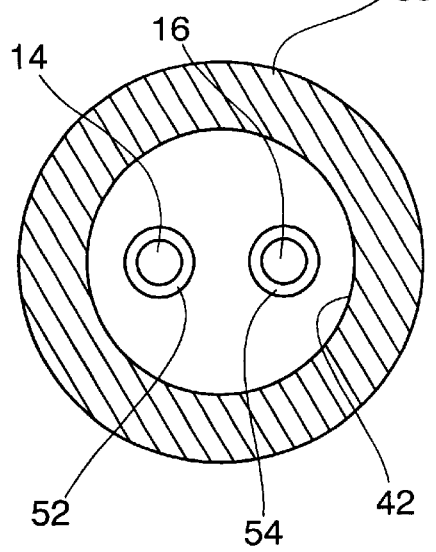

In FIG. 4A, conductors 14 and 16 both pass through the opening within tubular insulator 36 and would, if not otherwise insulated from each other, contact with each other causing a short circuit. Accordingly, an insulating sheath 52 is placed over conductor 14 and as a similar insulating sheath 54 is placed over conductor 16 as they pass through opening 42 within the tubular insulator 36 so that no short circuit exists and so that any voltage applied to insulated conductors 48 and 50 cause the current to flow only through resistor 10.

FIG. 4 shows a cup wad seal 56 that can be used to produce a metal "flyer" end cap for use in activating sequential explosions as sometimes used in geophysical prospecting.

Figure 3:
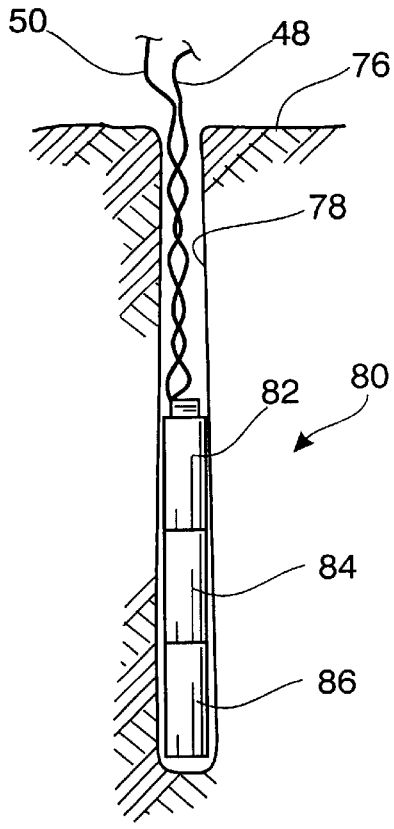
FIG. 3 PRIOR ART
FIG. 3 shows another means of using the invention in which a housing formed of three segments is positioned in a small diameter hole drilled in the earth's surface. The housing in the illustrated arrangement receives three shotgun type shells, at least one of which has an explosive detonator according to the invention, with wires extending from the detonator to the earth's surface.

FIGS. 2 and 3 are elevational views illustrating in side by side arrangement two basic means of making use of the invention. FIG. 2 shows a down-hole electric firing rod assembly while FIG. 3 shows a down-hole electric wired assembly. These methods of using explosive charges in seismograph work are illustrated and described in detail in U.S. Pat. No. 4,867,266 that issued on Sep. 19, 1989 and entitled "Seismic Energy Source". U.S. Pat. No. 4,867,266 is incorporated herein by reference. A down-hole firing assembly is generally indicated by the numeral 58. The assembly includes a tubular body 60 preferably formed of metal having integrally extending handles 62. At the top of the tubular body 60 is a head 64 which has internal threads at the lower end engaging external threads on the upper end of the tubular body 60 and further, having internal threads at the upper end that receive a tubular connector 66. Conductors 48 and 50 extend from tubular connector 66, the conductors being extensions of conductors 48 and 50 as seen in FIG. 4.

Affixed to the lower end of tubular body member 60 is a coupling 68 to which is secured the shell containing portion of the apparatus. Affixed to the lower end of coupling 68 is a tubular shell capsule 70 that can be made of plastic. Shell capsule 70 receives a shell such as shell 18A as seen in FIG. 4. Shell capsule 70 has internal threads that receive a second shell capsule 72 which is substantially identical to first shell capsule 70 and also contains a shell such as shell 18A of FIG. 4.

A flange 74 which can be made of rubber or plastic surrounds tubular body 60 and is positioned to rest upon the earth's surface 76 and cover a small diameter borehole 78 formed in the earth's surface.

A shell such as shell 18A of FIG. 4 is positioned in each of the shell capsules 70 and 72 with conductors 48 and 50 extending from the assembly. An electric voltage can be applied to the conductors firing the shell in the top shell capsule 70 and bottom shell capsule 72 simultaneously or only the shell in top capsule 70 may be electronically fired, the shell in the bottom capsule 72 being fired when impacted by a flyer (not shown) positioned within cup wad seal 56. The primary purpose of the flyer is to detonate by impact shock those explosives that cannot be ignited by heat of explosion.

FIG. 3 is the illustration of a down-hole electric wired seismic generating signal assembly generally indicated by the numeral 80. The assembly employs an upper shell capsule 82, an intermediate shell capsule 84 and a lower shell capsule 86. Shell capsules 82, 84 and 86 can be formed of metal or plastic and for seismic exploration forming the shell casings of plastic is preferred. Positioned within upper shell casing 82 is an electric fired shell such as that illustrated in FIG. 4 having conductors 48 and 50 extending from it. Within intermediate shell capsule 84 and lower shell capsule 86 are shells having percussion caps that are fired automatically in sequence when the shell in the upper casing 82 is fired.

The illustrations in FIGS. 2 and 3 are of the prior art as having been revealed and described in U.S. Pat. No. 4,867,266 and are included to illustrate how the unique electrically activated explosive detonator of this invention is employed for producing signals utilized for seismic exploration.

The power source required to initiate the explosive detonator shown in the assembly of FIGS. 1, 1A and 4 can be any source that produces sufficient and immediate current flow through resistor 10 to cause the resistors instantaneous disintegration. As an example, when resistor 10 is a 20 ohm, ¼ watt carbon film resistor, a voltage source such as 110/120 volts A/C at 60 cycles is ideal to initiate an explosion—that is, to cause the immediate and instantaneous disintegration of resistor 10 when such voltage is applied across conductors 48 and 50 in the embodiment of FIG. 4 or when applied across metal head 20 and top hat 34 of primer cap 30 in FIG. 1A. A 60 watt power source providing approximately 110 volts A/C or D/C can be used to cause the sudden and immediate disintegration of a ¼ watt 20 ohm carbon film resistor and such voltage can easily be obtained, as previously indicated by use of an inverter operating on a 12 volt D/C battery.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

The exact ohmage and wattage of resistor 10 can vary considerably, as well as the voltage source used to cause instantaneous disintegration of the resistor. Any combination of a small, commercially available resistor used in electrical or electronic circuits combined with a power source to cause the resistor's instantaneous disintegration by excess current flow is within the scope of this invention.

The carbon film electric detonator of this disclosure cannot be ignited by heat, impact, friction, static electricity or radio signal, all of which are hazards with conventional primers, caps, etc., which contain small amounts of extremely sensitive explosive compounds For ¼ watt, 20 ohm carbon film resistors the range for reliable use is −55° C. to 155° C., and performance is not affected by humidity. In contrast, existing electric and percussion primer mixes in common wide-spread use have a useful range that is limited to −40° C. to 50° C. and all of them will deteriorate in prolonged high humidity.

While the invention has been described with a certain degree of particularity, it is manifest that many changes maybe made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. An electric actuated explosive detonator, comprising:

a confined explosive charge capable of being detonated by heat and/or shock; and an electrical small wattage carbon film resistor positioned in engagement with said confined explosive charge, the resistor having two electrical contacts and having a predetermined electric current carrying capability and subject to receiving, by the application of an eletrical energy source, sufficient voltage and wattage that an instantaneous current flow causes the resistor's immediate disintegration.

2. An electrical activated explosive detonator according to claim 1 wherein said explosive charge is in the form of a powder-like or granulated material and said resistor is embedded within said explosive charge.

3. An electrical activated explosive detonator according to claim 1 wherein said explosive charge is confined within a shell cartridge having a metal head and casing, said resistor being positioned through an opening in said metal head.

4. An electrical activated explosive detonator according to claim 3 including a wire extending from each of said resistors electric contacts wherein one of said wires is in continuity with said shell cartridge metal head.

5. An electric actuated explosive detonator according to claim 3 including a tubular insulation sleeve within said opening in said metal head including a conductive button having a neck portion received within said tubular insulation sleeve, the button being in conductive communication with one of said electrical contacts.

6. An electric activated explosive detonator according to claim 1 wherein said resistor is subject to immediate disintegration by the application of DC voltage.

7. An electric actuated explosive detonator according to claim 1 wherein said resistor is of size of about ¼ watt.

8. An electric activated explosive detonator according to claim 1 wherein said resistor is of about 20 ohms resistance.

9. An electric activated explosive detonator according to claim 1 wherein said resistor is subject to disintegration by the application of AC voltage.

10. An electric actuated explosion detonator for use to detonate an explosive charge, comprising:

an electrical small wattage carbon film resistor having two electrical contacts and having a predetermined electric current carrying capability and subject to receiving, by the application of an electrical energy source, sufficient voltage and wattage that an instantaneous current flow causes the resistor's immediate disintegration, the resistor being positionable in engagement with an explosive charge.

11. An electrical activated explosion detonator according to claim 10 wherein the explosive charge is confined within a shell cartridge having a metal head and a casing and wherein said resistor is positioned through an opening in said metal head.

12. An electrical activated explosion detonator according to claim 11 including a wire extending from each of said resistors electric contacts wherein one of said wires is in continuity with said shell cartridge metal head.

13. An electric actuated explosion detonator according to claim 11 including a tubular insulation sleeve within said opening in said metal head including a conductive button having a neck portion received within said tubular insulation sleeve, the button being in conductive communication with one of said electrical contacts.

14. An electric actuated explosion detonator according to claim 10 wherein said resistor is of about 20 ohms resistance.

15. An electric activated explosion detonator according to claim 10 wherein said resistor is of subject to disintegration by the application of AC voltage.

16. An electric activated explosion detonator according to claim 10 wherein said resistor is subject to immediate disintegration by the application of DC voltage.

* * * * *